US011409237B2

(12) United States Patent
Iwata

(10) Patent No.: US 11,409,237 B2
(45) Date of Patent: Aug. 9, 2022

(54) DEVELOPING APPARATUS WITH AN AIRFLOW PASSAGE TO PROVIDE AIR FLOW AT A LONGITUDINAL END OF A DEVELOPER ROLLER

(71) Applicant: HEWLETT-PACKARD DEVELOPMENT COMPANY, L.P., Spring, TX (US)

(72) Inventor: Naoya Iwata, Kanagawa (JP)

(73) Assignee: Hewlett-Packard Development Company, L.P., Spring, TX (US)

( * ) Notice: Subject to any disclaimer, the term of this patent is extended or adjusted under 35 U.S.C. 154(b) by 21 days.

(21) Appl. No.: 17/051,217

(22) PCT Filed: Jul. 18, 2019

(86) PCT No.: PCT/US2019/042371

§ 371 (c)(1),
(2) Date: Oct. 28, 2020

(87) PCT Pub. No.: WO2020/018770

PCT Pub. Date: Jan. 23, 2020

(65) Prior Publication Data

US 2021/0373456 A1 Dec. 2, 2021

(30) Foreign Application Priority Data

Jul. 20, 2018 (JP) ..... JP2018-137154

(51) Int. Cl.
*G03G 21/20* (2006.01)
*G03G 15/08* (2006.01)
(Continued)

(52) U.S. Cl.
CPC ..... *G03G 21/206* (2013.01); *G03G 15/0813* (2013.01); *G03G 15/0817* (2013.01);
(Continued)

(58) Field of Classification Search
CPC ..... G03G 21/206; G03G 21/0052; G03G 15/0813; G03G 15/0817; G03G 15/0896;
(Continued)

(56) References Cited

U.S. PATENT DOCUMENTS 8,923,723 B2 12/2014 Hirakawa et al.
2004/0052545 A1* 3/2004 Satoh ..... G03G 21/206 399/92

FOREIGN PATENT DOCUMENTS

JP S63311284 12/1988
JP 19940027794 2/1994
(Continued)

*Primary Examiner* — Joseph S Wong
(74) *Attorney, Agent, or Firm* — Trop Pruner & Hu, P.C.

(57) ABSTRACT

A developing device includes a developer roller to rotate in a rotation direction, a photosensitive body adjacent the developer roller, and an air flow passage extending through a non-image forming region at a longitudinal end of the developer roller. A closest position is defined where the developer roller and a photosensitive body are closest to one another. The air flow passage extends from inside the developing device and forms an air flow directed toward an upstream side of the closest position, relative to the rotation direction of the developer roller.

14 Claims, 7 Drawing Sheets

(51) Int. Cl.
*G03G 21/00* (2006.01)
*G03G 9/00* (2006.01)

(52) U.S. Cl.
CPC ..... *G03G 15/0896* (2013.01); *G03G 21/0052* (2013.01); *G03G 9/00* (2013.01); *G03G 2215/0602* (2013.01); *G03G 2215/08* (2013.01); *G03G 2215/0872* (2013.01); *G03G 2221/0094* (2013.01); *G03G 2221/1645* (2013.01)

(58) Field of Classification Search
CPC ..... G03G 9/00; G03G 2215/0602; G03G 2215/08; G03G 2215/0872; G03G 2221/0094; G03G 2221/1645
See application file for complete search history.

(56) References Cited

FOREIGN PATENT DOCUMENTS

| | | | |
|---|---|---|---|
| JP | 20020278268 | | 9/2002 |
| JP | 2007226114 | | 9/2007 |
| JP | 2009036875 | A | 2/2009 |
| JP | 20110090130 | | 5/2011 |
| JP | 2013195492 | A | 9/2013 |
| JP | 5327573 | B2 | 10/2013 |
| JP | 20170191233 | | 10/2017 |

* cited by examiner

DEVELOPING APPARATUS WITH AN AIRFLOW PASSAGE TO PROVIDE AIR FLOW AT A LONGITUDINAL END OF A DEVELOPER ROLLER

BACKGROUND

Some developing devices for use with an image forming apparatus such as a printer or a multifunctional machine use as the developer a two-component developer including toner and carrier, and include a developer roller, a layer regulating member, a mixing and stirring member, a developer container, and the like. During operation, the developer stored in the developer container is stirred by the mixing and stirring member, transported and magnetically absorbed onto the rotating developer roller, and further formed into a thin layer of developer by the layer regulating member, and the toner is then absorbed from the thin layer of developer to an electrostatic latent image on a rotating photosensitive body for developing the electrostatic latent image. During operation of such a developing device, the air outside of the developing device is introduced into the developing device by the developer on the rotating developer roller.

DETAILED DESCRIPTION

Figure 1:
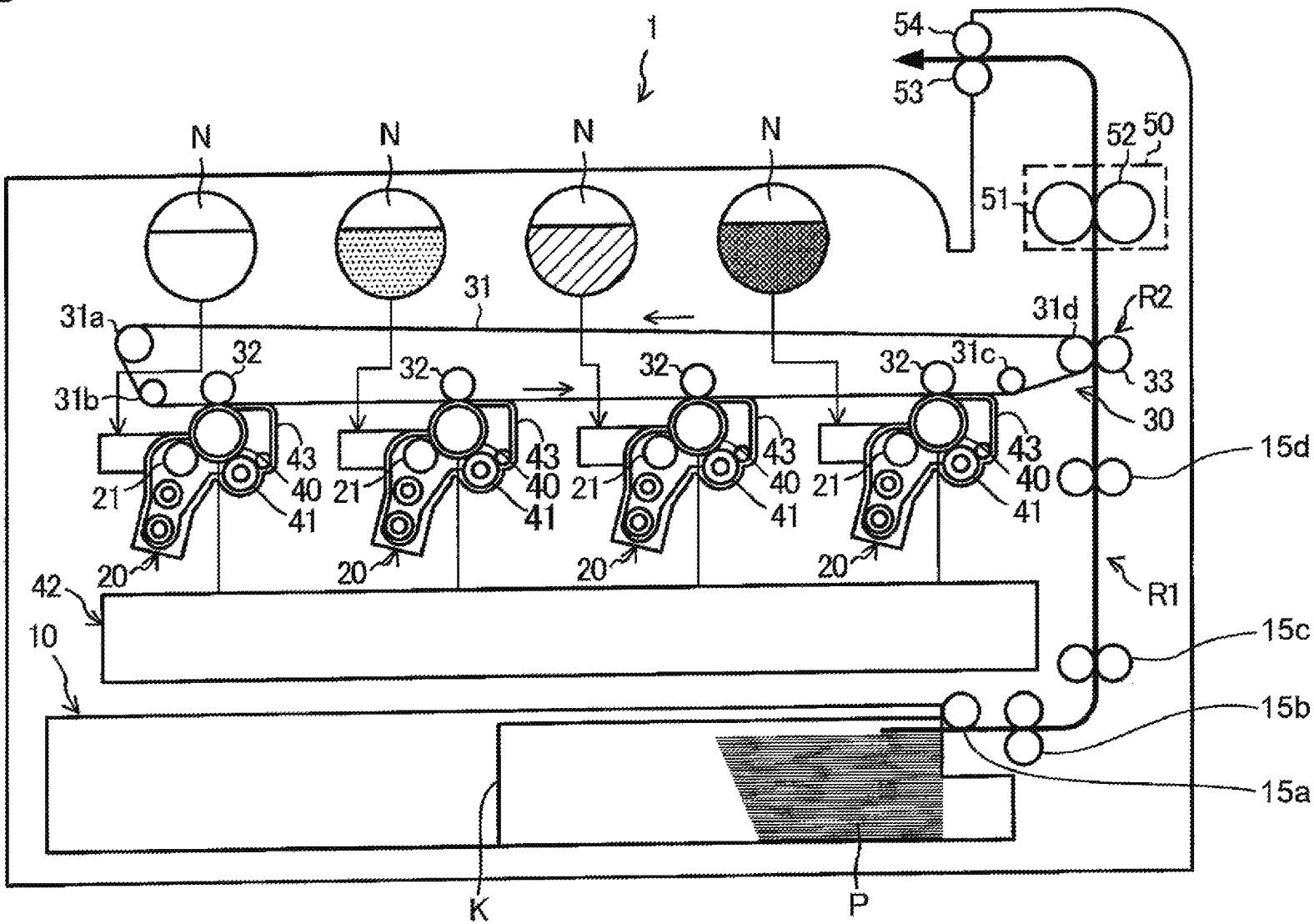
FIG. 1 is a schematic diagram showing one example of an image forming apparatus.

In the following description, with reference to the drawings, the same reference numbers are assigned to the same components or to similar components having the same function, and overlapping description is omitted.

An example developing device for use with a two-component developer includes an air flow passage extending from inside of the developing device and directed upstream, in a rotation direction of the developer roller, of a position at which the developer roller and a photosensitive body are closest, through at least one of non-image forming regions located at both longitudinal ends of an image forming region of the developer roller. This example developing device can circulate air through the flow passage between the inside and the outside of the developing device, thereby suppressing increase in the internal pressure of the developing device, while suppressing new introduction of air from the outside into the developing device and, as a result, can alleviate scattering of toner within a printer, excessive discharge of the developer from a developer replenishing device as described further below, and the aforementioned effects stemming from these.

In an example developing device, the flow passage extends toward upstream, in the rotation direction of the developer roller (e.g. relative to the rotation direction of the developer roller), of the position at which the photosensitive body and the developer roller are closest, and downstream, in the rotation direction of the developer roller, of the layer regulating member. This example developing device can circulate air between the inside and the outside of the developing device, through the flow passage extending toward the side which is upstream, in the rotation direction of the developer roller, of the position at which the photosensitive body and the developer roller are closest, and which is downstream, in the rotation direction of the developer roller, of the layer regulating member, such that the developer on the developer roller can capture and collect splashed toner.

In an example developing device, a first seal member adjacent to or in contact with the developer on the developer roller is disposed upstream, in the rotation direction of the developer roller, of the position at which the photosensitive body and the developer roller are closest, and downstream of the layer regulating member in the rotation direction of the developer roller. This example developing device can define the flow passage for air by the first seal member, the developer roller and the layer regulating member, thereby enabling to perform the circulation of air and the capturing of toner more efficiently.

In an example developing device having disposed therein the first seal member, at least one or more magnetic poles of the developer roller may be disposed in a range which is upstream, in the rotation direction of the developer roller, of the first seal member, and which is downstream, in the rotation direction of the developer roller, of the layer regulating member. In this example developing device, as the developer on the developer roller has a maximum height at the center of the magnetic pole of the developer roller in a direction normal to the surface of the developer roller and is tilted at front or rear thereof toward the tangential directions of the developer roller, capturing of splashed toner by the developer can be made more efficiently by disposing the magnetic pole in the region of the developer roller opposing the first seal member.

In another example developing device, a second seal member is adjacent to or in contact with the developer on the developer roller, and is disposed in a developer container at a side downstream, in the rotation direction of the developer roller, of the position at which the photosensitive body and the developer roller are closest. This example developing device can suppress scattering of the toner by preventing with the second seal member leakage of air through a gap between the developer container and the developer roller, and can also facilitate flow of air through the flow passage by enhancing the airtightness of the developing device.

In an example developing device, an air vent with a filter is disposed in the developer container. In this example developing device, as the air vent with the filter is disposed in the developer container, pressure loss may be made in addition to the flow passage, so as to achieve a further decrease in the internal pressure.

In an example developing device, the air vent may be positioned downstream, in the rotation direction of the developer roller, of a position at which the developer roller and the developer container are closest, and upstream of the layer regulating member in the rotation direction of the developer roller. As this example developing device is substantially airtight, pressure tends to increase in an internal region of the developing device between the position at which the developer roller and the developer container are closest and the position of the layer regulating member disposed downstream in the rotation direction of the developer roller. Accordingly, the air vent disposed in this region can effectively decrease the internal pressure of the region.

In an example developing device, the portion of the flow passage disposed inside the developing device is located downstream, in the rotation direction of the developer roller, of the position at which the developer roller and the developer container are closest, and upstream of the layer regulating member in the rotation direction of the developer roller. As this example developing device is substantially airtight and pressure tends to increase in the internal region of the developing device between the position at which the developer roller and the developer container are closest and the position of the layer regulating member disposed downstream in the rotation direction of the developer roller, increase in the internal pressure of the developing device can be effectively suppressed by adapting this region to discharge air.

In an example developing device, in the non-image forming regions located at both longitudinal ends of the image forming region of the developer roller, the flow passage is formed with an opening to fluidly communicate with an interior of the developer container, and the flow passage extends from the inside of the developing device to the outside of the developing device through the opening. In this example developing device, with the opening formed in the flow passage, clogging of the flow passage by the toner or carrier entrained in the air passing through the flow passage can be prevented.

An example method for suppressing internal pressure of an example developing device for use with a two-component developer is provided, wherein an air flow passage is disposed to extend from inside of the developing device and directed toward upstream, in a rotation direction of the developer roller, of a position at which the developer roller and a photosensitive body are closest, through at least one of non-image forming regions located at both longitudinal ends of an image forming region of the developer roller. This example method can circulate air through the flow passage between the inside and the outside of the developing device, thereby suppressing increase in the internal pressure of the developing device, while suppressing new introduction of air from the outside into the developing device and, as a result, can alleviate scattering of toner within a printer, excessive discharge of the developer from a developer replenishing device, and the aforementioned effects stemming from these.

In an example method, the flow passage extends toward upstream, in the rotation direction of the developer roller, of the position at which the photosensitive body and the developer roller are closest, and downstream of the layer regulating member in the rotation direction of the developer roller. This example method allows to circulate air between the inside and the outside of the developing device, through the flow passage extending toward the side which is upstream, in the rotation direction of the developer roller, of the position at which the photosensitive body and the developer roller are closest, and which is downstream, in the rotation direction of the developer roller, of the layer regulating member, such that the developer on the developer roller can capture and collect splashed toner.

In an example method, a first seal member adjacent to or in contact with the developer on the developer roller is disposed upstream, in the rotation direction of the developer roller, of the position at which the photosensitive body and the developer roller are closest, and downstream of the layer regulating member in the rotation direction of the developer roller. This example method can define the flow passage for air by the first seal member, the developer roller and the layer regulating member, thereby enabling to perform the circulation of air and the capturing of toner more efficiently.

In an example method having disposed therein the first seal member is provided, at least one or more magnetic poles of the developer roller are disposed in a range which is upstream, in the rotation direction of the developer roller, of the first seal member, and which is downstream, in the rotation direction of the developer roller, of the layer regulating member. As the developer on the developer roller has a maximum height at the center of the magnetic pole of the developer roller in a direction normal to the surface of the developer roller and is tilted at a front or a rear thereof toward the tangential directions of the developer roller, this example method enables to capture splashed toner by the developer more efficiently by disposing the magnetic pole in the region of the developer roller opposing the first seal member.

In an example method, a second seal member is adjacent to or in contact with the developer on the developer roller, and is disposed in a developer container at a side downstream, in the rotation direction of the developer roller, of the position at which the photosensitive body and the developer roller are closest. This example method can suppress scattering of the toner by preventing with the second seal member, leakage of air through a gap between the developer container and the developer roller, and can also facilitate flow of air through the flow passage by enhancing the airtightness of the developing device.

In an example method, an air vent with a filter is disposed in the developer container, and the air vent is positioned downstream, in the rotation direction of the developer roller, of a position at which the developer roller and the developer container are closest, and upstream of the layer regulating member in the rotation direction of the developer roller. As the example developing device is substantially airtight and pressure tends to increase in an internal region of the developing device between the position at which the developer roller and the developer container are closest and the position of the layer regulating member disposed downstream in the rotation direction of the developer roller, this example method can effectively decrease the internal pressure of the region by disposing the air vent in this region.

In an example method, in the non-image forming regions located at both longitudinal ends of the image forming region of the developer roller, the flow passage is formed with an opening to fluidly communicate with an interior of the developer container, and the flow passage extends from the inside of the developing device to the outside of the developing device through the opening. In this example method, clogging of the flow passage by the toner or carrier entrained in the air passing through the flow passage can be prevented by forming the opening in the flow passage.

FIG. 1 schematically shows an example of an image forming apparatus 1 which may employ an example developing device. As shown in FIG. 1, the image forming apparatus 1 is an apparatus to form color images using toner cartridges N of magenta, yellow, cyan and black colors. The image forming apparatus 1 forms an image on a paper sheet (recording medium) P.

The image forming apparatus 1 is provided, for example, with a recording medium conveyance unit 10 for conveying a paper sheet P, developing devices 20 for developing an electrostatic latent image, a transfer unit 30 for secondarily transferring the toner image to the paper sheet P, photosensitive bodies 40 that are electrostatic latent image carriers, on circumferential surfaces of which images are formed, and a fixation unit 50 for fixing the toner image onto the paper sheet P.

The recording medium conveyance unit 10 conveys a paper sheet P to be formed with an image along a conveyance path R1. The paper sheet P is stacked and contained in a cassette K, picked up by paper feed rollers 15*a*-15*d* and conveyed. The recording medium conveyance unit 10 conveys the paper sheet P to a secondary transfer region R2 through the conveyance path R1 in such a timing that a toner image to be transferred to the paper sheet P arrives at the secondary transfer region R2.

Four developing devices 20 are provided, for example, for the respective colors. Each of the example developing devices 20 is provided with a developer roller 21 for carrying toner to the photosensitive body 40. In the developing device 20, toner and carrier are adjusted to have a desired mixing ratio. The toner is uniformly dispersed to prepare a developer imparted with an optimal amount of charge. The developer is carried by the developer roller 21. As the developer roller 21 rotates to carry the developer to a region opposing the photosensitive body 40, toner is moved out of the developer carried on the developer roller 21 and onto an electrostatic latent image formed on a circumferential surface of the photosensitive body 40 to develop the electrostatic latent image.

The transfer unit 30 carries the toner image formed with the developing device 20 to the secondary transfer region R2 where the toner image is secondarily transferred to the paper sheet P. The transfer unit 30 is provided with a transfer belt 31, support rollers 31*a*, 31*b*, 31*c* and 31*d* for supporting the transfer belt 31, primary transfer rollers 32 for holding the transfer belt 31 with the photosensitive bodies 40, and a secondary transfer roller 33 for holding the transfer belt with the support roller 31*d*.

The transfer belt 31 is an endless belt circularly moved by the support rollers 31*a*, 31*b*, 31*c* and 31*d*. The primary transfer rollers 32 are disposed to press the photosensitive bodies 40 from the inside of the transfer belt 31. The secondary transfer roller 33 is disposed to press the support roller 31*d* from the outside of the transfer belt 31.

Four photosensitive bodies 40 are provided for the respective colors. Each of the photosensitive bodies 40 is provided along the direction of movement of the transfer belt 31. Around the circumference of the photosensitive body 40, the developing device 20, a charge roller 41, an exposure unit 42 and a cleaning unit 43 are arranged.

The charge roller 41 is a charge means for uniformly charging the surface of the photosensitive body 40 at a predetermined potential. The charge roller 41 is driven to follow the rotation of the photosensitive body 40. The exposure unit 42 exposes the surface of the photosensitive body 40 charged by the charge roller 41 in accordance with an image to be formed on the paper sheet P. The potential of portions of the surface of the photosensitive body 40 exposed by the exposure unit 42 is thereby changed to form an electrostatic latent image. The four developing devices 20 each uses the toner supplied from the toner cartridge N provided opposite to the developing device 20 to develop the electrostatic latent image formed on the photosensitive body 40 and creates a toner image. The toner cartridges N are respectively filled with magenta, yellow, cyan and black toners. The cleaning unit 43 recovers the toner remaining on the photosensitive body 40 after the toner image formed on the photosensitive body 40 has been primarily transferred onto the transfer belt 31.

The fixation unit 50 adheres and fixates onto the paper sheet P the toner image that has been secondarily transferred from the transfer belt 31 to the paper sheet P. The fixation unit 50 is provided with a heater roller 51 for heating the paper sheet P and a pressure roller 52 for pressing the heater roller 51. The heater roller 51 and the pressure roller 52 are formed in cylindrical shapes, and the heater roller 51 is internally provided with a heat source such as a halogen lamp. A contact area called a fixation nip is formed between the heater roller 51 and the pressure roller 52, and the toner image is fused and fixated onto the paper sheet P while passing the paper sheet P through the fixation nip. After the toner image has been secondarily transferred onto the paper sheet P, the toner remaining on the transfer belt 31 is recovered by a belt cleaning device.

The example image forming apparatus 1 is further provided with discharge rollers 53 and 54 for discharging the paper sheet P with the fixated toner image to the outside of the apparatus.

A printing operation of the example image forming apparatus 1 will be described. When an image signal of a recording image is input to the image forming apparatus 1, the image forming apparatus 1 rotates the paper feed rollers 15*a*-15*d* to pick up and convey a paper sheet P stacked in the cassette K. Then, the surface of the photosensitive body 40 is uniformly charged at a predetermined potential by the charge roller 41 (charging). After that, based on the image signal received, an electrostatic latent image is formed by irradiating laser light onto the surface of the photosensitive body 40 with the exposure unit 42 (exposing).

In the developing device 20, the electrostatic latent image is developed to form a toner image (developing). Thus formed toner image is primarily transferred from the photosensitive body 40 to the transfer belt 31 in the region at which the photosensitive body 40 and the transfer belt 31 are opposed, i.e. aligned and facing one another (transferring). The toner images formed on the four photosensitive bodies 40 are successively overlaid to form a single overlaid toner image on the transfer belt 31. Then, the overlaid toner image is secondarily transferred onto the paper sheet P conveyed from the recording medium conveyance unit 10 in the secondary transfer region R2 at which the support roller 31*d* and the secondary transfer roller 33 are opposed, i.e. aligned and facing one another.

The paper sheet P, with the secondarily transferred overlaid toner image, is conveyed to the fixation unit 50. The overlaid toner image is fused and fixated onto the paper sheet P while the paper sheet P is made to pass under heat and pressure between the heater roller 51 and the pressure roller 52 (fixating). After that, the paper sheet P is discharged to the outside of the image forming apparatus 1 by the discharge rollers 53 and 54.

Figure 2:
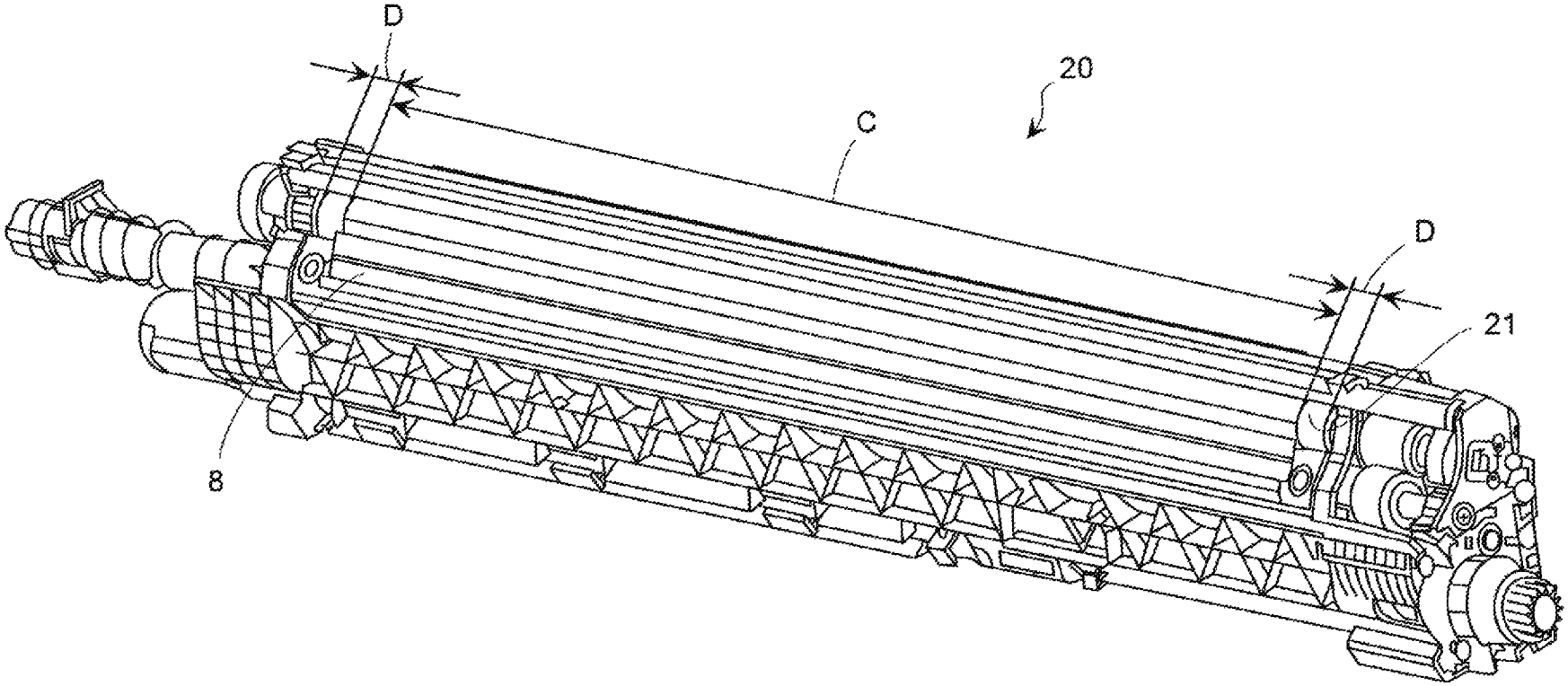
FIG. 2 is a perspective view showing one example of a developing device.

FIG. 2 is a perspective view showing one example of the developing device 20. The developer roller 21 has an image forming region C, on which the developer is adsorbed, and non-image forming regions D, on which no developer is adsorbed, located at both longitudinal ends of the image forming region C. The layer regulating member (hidden behind a protective cover 8 and not shown in FIG. 2) has a longitudinal length approximately equal to that of the developer roller 21 and aligned with the developer roller 21 in the longitudinal direction. The protective cover 8 has a longitudinal length approximately equal to the longitudinal length of the layer regulating member and aligned with the layer regulating member in the longitudinal direction.

Figure 3:
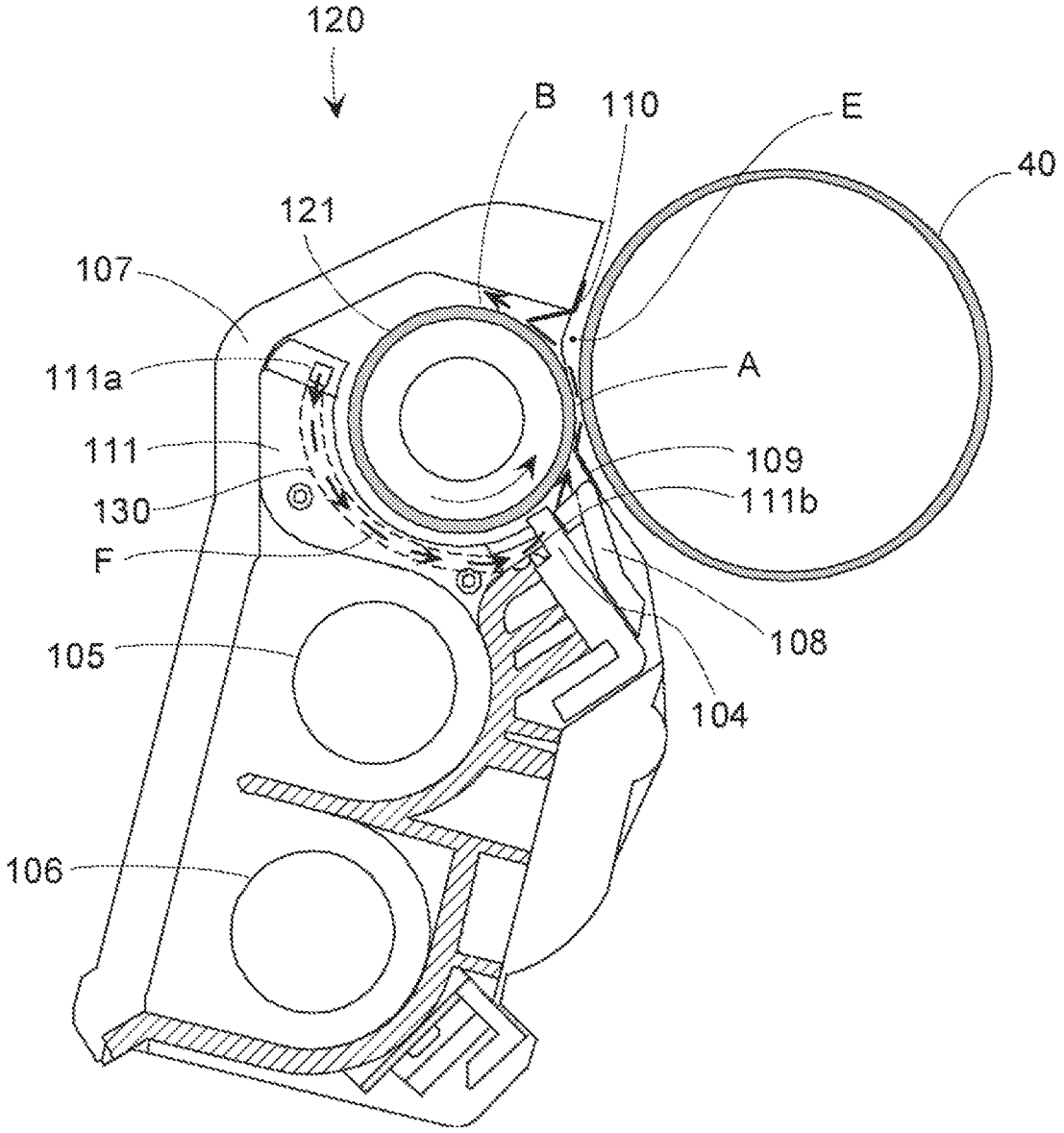
FIG. 3 is a schematic diagram showing an example developing device.

FIG. 3 is a lateral side view showing an example developing device 120, along with a photosensitive body 40. The photosensitive body 40 forms part of a photosensitive device (not shown), but FIG. 3 shows the photosensitive body 40 without other parts of the photosensitive device, for clarity of explanation. The developing device 120 includes, for example, a developer container 107 for containing a developer (not shown) comprising toner and carrier, mixing and stirring members 105, 106 for stirring the developer in the developer container 107, a developer roller 121 for magnetically adsorbing the developer stirred and transported by the mixing and stirring members 105, 106, a layer regulating member 104 for shaping the developer adsorbed onto the developer roller 121 into a thin layer of developer, a protective cover 108 for protecting the layer regulating member 104, a seal member 109 disposed on the protective cover 108 adjacent to or in contact with the developer on the developer roller 121, a seal member 110 disposed in the developer container 107 adjacent to or in contact with the developer on the developer roller 121, and a flow passage forming member 111 for fluidly communicating the interior of the developing device 120 with the exterior of the developing device 120. The flow passage forming member 111 includes, for example, an inlet 111*a* located inside the developing device 120 (at an inlet position). A symbol A denotes a position at which the developer roller 121 and the photosensitive body 40 are closest (e.g. a first closest position A), and a symbol B denotes a position at which the developer container 107 and the developer roller 121 are closest (e.g. a second closest position B). The developing device 120 may further include, for example, a developer replenishing device (not shown) for discharging degraded carrier while replenishing lacking carrier, and a toner density sensor (not shown) for detecting a toner density of the developer.

The seal member 109 may have a longitudinal length approximately equal to the whole length of the developer roller 121, including an image forming region and non-image forming regions at respective ends of the developer roller 121 (similarly to the image forming region C and the non-image forming regions D at the respective ends of the developer roller 21, shown in FIG. 2), and is disposed such that one edge along the longitudinal length thereof is adjacent to or in contact with the developer on the developer roller 121. Depending on embodiments, the seal member 109 may be formed integrally with the protective cover 108, or the seal member 109 may be disposed without any protective cover. Alternatively, seal member 109 may be provided separately from an existing seal member (not shown) having a longitudinal length approximately equal to the image forming region of the developer roller 121 and disposed on the protective cover 108 in contact with the photosensitive body 40 for preventing a foreign material such as toner scattered, for example, through a gap between the photosensitive body 40 and the developer roller 121 from contaminating the exposure unit 42.

Figure 4:
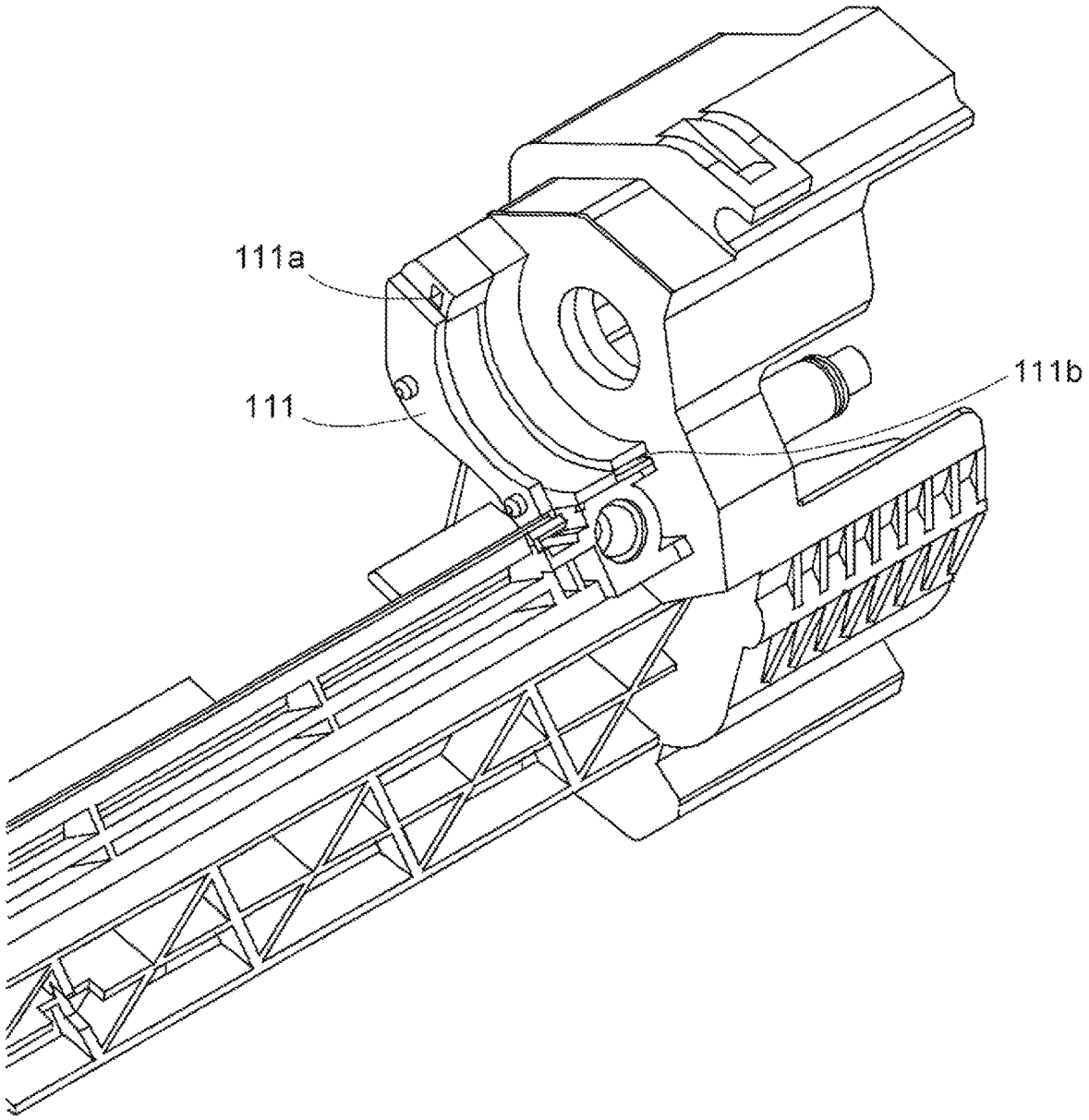
FIG. 4 is a perspective partial view of an example developing device, showing a flow passage forming member.
Figure 5:
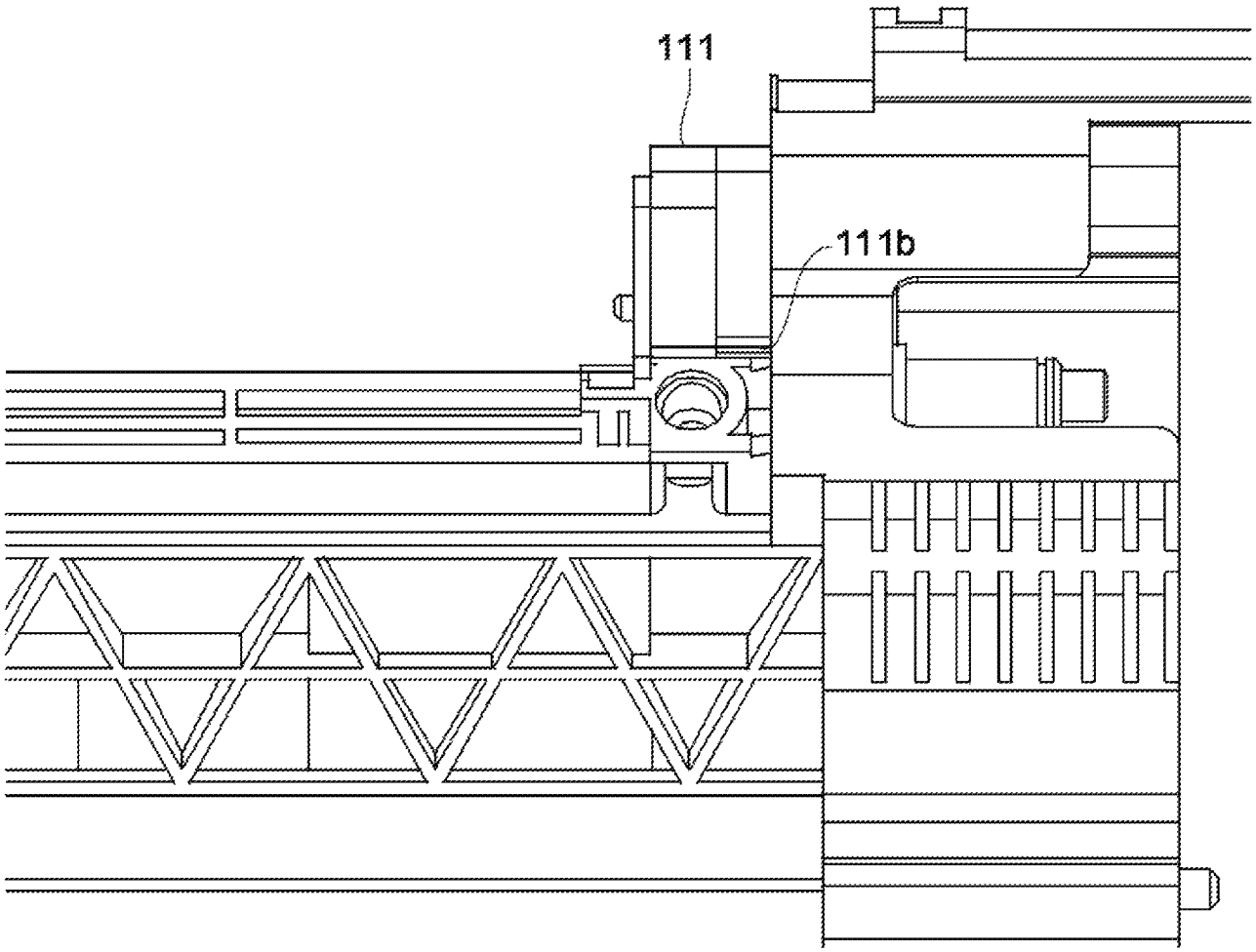
FIG. 5 is a front partial view of an example developing device, showing the flow passage forming member in detail.

FIG. 4 is a perspective view showing part of the developing device 120 in a state where the developer roller 121, the mixing and stirring members 105, 106, the layer regulating member 104 and the protective cover 108 have been removed from the developing device 120 shown in FIG. 3, in order to show further details of the flow passage forming member 111, and FIG. 5 is a front view thereof. The flow passage forming member 111 is disposed in at least one of the non-image forming regions at the ends of the image forming region of the developer roller 121. Further, the flow passage forming member 111 has, in addition to the inlet 111*a*, an outlet 111*b* located to channel air outside the developing device 120 (at an outlet position), and the inlet 111*a* and the outlet 111*b* are fluidly communicated with each other. The outlet 111*b* may be located, at least in part, outside the developing device 120. As indicated above, the flow passage forming member 111 is disposed in at least one of the non-image forming regions at the ends of the image forming region of the developer roller 121, and the layer regulating member 104 has, for example, a longitudinal length approximately equal to the whole length of the image forming region. Accordingly, the air discharged from the outlet 111*b* is not hindered by the layer regulating member 104.

Figure 6:
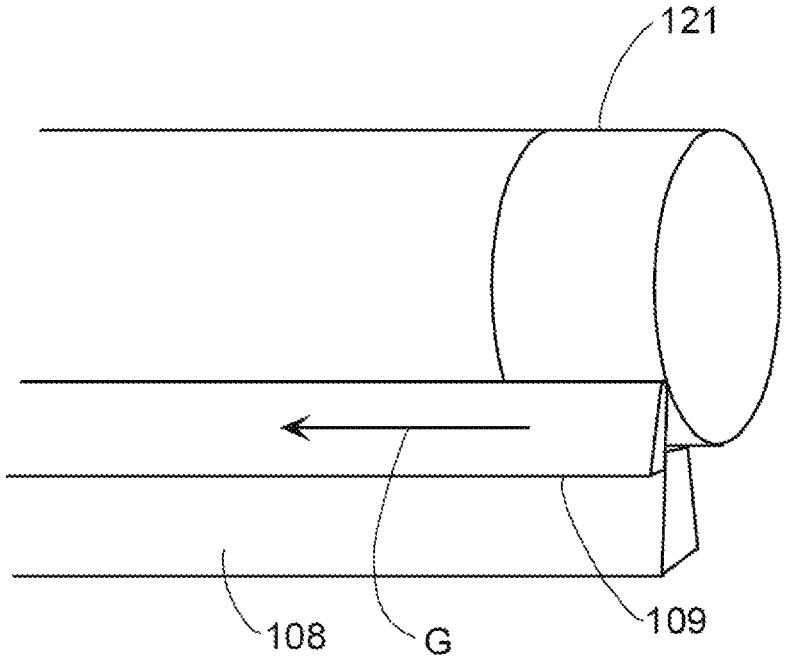
FIG. 6 is a simplified diagram of part of an example developing device, showing a direction of an airflow.

FIG. 6 is a simplified perspective view showing part of the developing device 120 shown in FIG. 3, in order to show a direction G in which the air discharged from the at least one of the non-image forming regions at the ends of the image forming region of the developer roller 121 flows along the longitudinal direction of the developer roller 121 into the image forming region.

Referring back to FIG. 3, during the operation of the developing device 120, the developer contained in the developer container 107 is stirred and transported by the rotating mixing and stirring members 105, 106, magnetically adsorbed onto the rotating developer roller 121, shaped into a thin layer of developer by the layer regulating member 104, and the toner is adsorbed from the thin layer of developer onto an electrostatic latent image on the rotating photosensitive body 40 for developing the electrostatic latent image.

During such operation of the developing device 120, the air external to the developing device 120 is taken into the interior of the developing device 120 from, for example, a position indicated by a symbol E in FIG. 3, through the position B at which the developer container 107 and the developer roller 121 are closest, by the developer on the developer roller 121 rotated in the direction indicated by the solid arrow in the figure. Then the air proceeds to flow from the inlet 111*a* to the outlet 111*b* of the flow passage forming member 111 through an air flow passage 130 (cf. FIG. 3), and discharged from the outlet 111*b* to the exterior of the developing device 120. The air discharged from the outlet 111*b* flows in a direction indicated by the arrow G in FIG. 6, through a passage formed by the developer roller 121, the layer regulating member 104, the protective cover 108 and the seal member 109, during which scattered toner entrained in the air stream is adsorbed to the developer on the developing roller 121 and collected thereby, and the air is once again taken by the developer into the interior of the developing device 120 through the closest positions A, B. A path F of such air circulation is shown in FIG. 3 by dotted arrows.

For example, the air taken into the interior of the developing device 120 flows, from the interior of the developing device 120 and through at least one of the non-image forming regions located at the longitudinal ends of the image forming region of the developer roller 121, along an air flow passage directed toward upstream, in the direction of rotation of the developer roller 121, of the closest position A between the developer roller 121 and the photosensitive body 40. For example, with reference to FIG. 3, the air flow passage 130 may extend from inside the developing device 120, at an inlet 111*a*, and direct an air flow F toward an outlet 111*b* located upstream, in the rotation direction of the developer roller, of the closest position A between the developer roller and the photosensitive body, through the non-image forming region of the developer roller 121.

As described above, by circulating air through the prescribed flow passage that communicates the interior of the developing device with its exterior, the developing device can suppress an increase in the internal pressure of the developing device while suppressing the introduction of new external air, and can also collect during the course of the circulation scattered toner entrained in the air. Such developing device can reduce contamination inside the printer by scattered toner caused by the air containing toner and discharged, due to increase in the internal pressure, to the exterior of the developing device from a portion of the developing device with low airtightness, as well as degradation of print quality concomitant with the contamination, and can further reduce excessive discharge of the developer from a developer discharge port of the developer replenishing device due to increase in the internal pressure of the developing device, thereby reducing the occurrence of image density unevenness attributable to excessive discharge of the developer, of reduced image density, and of inadequate toner/carrier mixing ratio due to detection error of a toner density sensor. Such occurrences tend to become prominent as the number of rotations of the developer roller increases. In the example developing device described herein, the amount of circulating air increases as the number of rotations of the developer roller increases, and the circulating air has a tendency to prevent the introduction of new external air. Accordingly, an increase in the internal pressure of the developing device can be suppressed.

Figure 7:
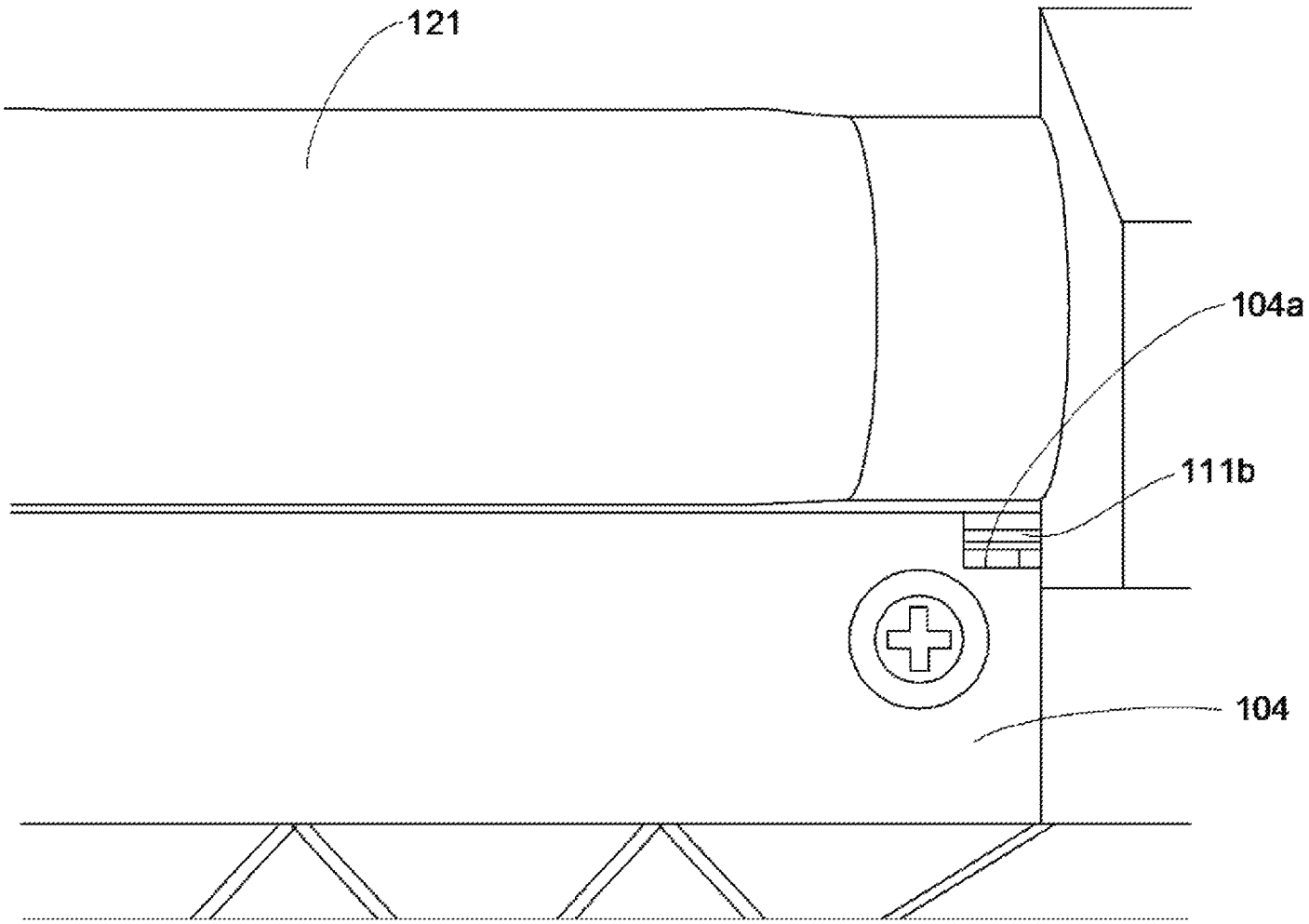
FIG. 7 is a perspective view of part of an example developing device having a cut formed in a layer regulating member.

In some examples, the layer regulating member 104 does not extend over the non-image forming regions in the construction described above. In some examples, when the layer regulating member 104 or any other component extends over the non-image forming regions, for example (the layer regulating member 104 may be disposed to close the outlet 111*b* of the flow passage forming member 111), the same effect as the aforementioned case can be obtained by forming an opening in that location. FIG. 7 shows an example of such a case. In this figure, the layer regulating member 104 is formed with a cut 104*a* as the opening, at a location opposing (e.g. facing and/or aligned with) the outlet 111*b* of the flow passage forming member 111 (see FIG. 4 and FIG. 5), so that the air discharged from the outlet 111*b* is not hindered by the layer regulating member 104.

Further, referring back to FIG. 3, for example, when the left-hand portion of the protective cover 108 is cut along the dotted line shown therein, the volume of the flow passage formed by the developer roller 121, the layer regulating member 104, the protective cover 108 and the seal member 109 can be increased, thereby enabling to capture the toner more efficiently. Further, while the flow passage from the interior to the exterior of the developing device 120 has been shown to be implemented by the flow passage forming member 111, any gap existing in the vicinity of the image forming regions of the developer roller and communicating from the interior to the exterior of the developing device (for example, an existing gap around a driving mechanism located in the non-image forming regions of the developer roller or in the vicinity thereof), for example, may be utilized as the air flow passage depending on the design of the developing device. Further, with reference to FIG. 3, while an increase in the internal pressure of the developing device 120 may be suppressed when the seal member 109 is disposed without disposing the seal member 110, the disposition of the seal member 110 in addition to the seal member 109 enables to prevent leakage of the air entraining scattered toner through the gap between the developer container 107 and the developer roller 121, and it also enables to enhance the airtightness of the developing device 120 so as to facilitate flow of air through the flow passage.

It is to be understood that not all aspects, advantages and features described herein may necessarily be achieved by, or included in, any one particular example. Indeed, having described and illustrated various examples herein, it should be apparent that other examples may be modified in arrangement and detail.

The invention claimed is:

1. A developing apparatus for use with a two-component developer, comprising:

a developer roller to rotate in a rotation direction, the developer roller extending longitudinally and having longitudinal ends, the developer roller having an image forming region located between the longitudinal ends, and a non-image forming region located at at least one of the longitudinal ends;

a photosensitive body adjacent the developer roller, wherein a closest position is defined where the developer roller and the photosensitive body are closest to one another; and an air flow passage extending from inside a developer container of the developing apparatus, the air flow passage to form an air flow directed toward an upstream side, relative to the rotation direction of the developer roller, of the closest position between the developer roller and the photosensitive body, the air flow passage extending through the non-image forming region of the developer roller.

2. The developing apparatus of claim 1, comprising a layer regulating member, the air flow passage to direct the air flow to a downstream side of the layer regulating member relative to the rotation direction of the developer roller.

3. The developing apparatus of claim 2, comprising a seal member adjacent to or in contact with the two-component developer on the developer roller, wherein the seal member is located at the upstream side of the closest position between the photosensitive body and the developer roller, and at the downstream side of the layer regulating member, relative to the rotation direction of the developer roller.

4. The developing apparatus of claim 3, wherein the developer roller has one or more of magnetic poles disposed within a range located at an upstream side of the seal member and at the downstream side of the layer regulating member, relative to the rotation direction of the developer roller.

5. The developing apparatus of claim 1, wherein the developer container houses the developer roller, the developing apparatus comprising a seal member adjacent to or in contact with the two-component developer on the developer roller, wherein the seal member is disposed in the developer container and the seal member is located at a downstream side, relative to the rotation direction of the developer roller, of the closest position between the photosensitive body and the developer roller.

6. The developing apparatus of claim 2, wherein the developer container houses the developer roller, the developing apparatus comprising an air vent with a filter located in the developer container, wherein:

the closest position between the photosensitive body and the developer roller is a first closest position, a second closest position is defined where the developer roller and the developer container are closest to one another, and the air vent is positioned at a downstream side of the second closest position and at an upstream side of the layer regulating member, relative to the rotation direction of the developer roller.

7. The developing apparatus of claim 2, wherein the developer container houses the developer roller, and wherein:

the closest position between the photosensitive body and the developer roller is a first closest position, a second closest position is defined where the developer roller and the developer container are closest to one another, and a portion of the air flow passage disposed inside the developer container is located at a downstream side of the second closest position and on an upstream side of the layer regulating member, relative to the rotation direction of the developer roller.

8. The developing apparatus of claim 1, wherein, in the non-image forming region of the developer roller, the air flow passage is formed with an opening to fluidly communicate with an interior of the developer container, and the air flow passage extends from inside of the developer container, via the opening, to outside of the developer container.

9. A method for suppressing an internal pressure of a developing device for use with a two-component developer, comprising:

directing an air flow from inside of the developing device and toward an upstream side, relative to a rotation direction of a developer roller, of a closest position at which the developer roller and a photosensitive body are closest to one another, wherein the air flow is directed through at least one of non-image forming regions located at longitudinal ends of an image forming region of the developer roller.

10. The method as in claim 9, wherein the air flow is directed to a downstream side of a layer regulating member relative to the rotation direction of the developer roller.

11. A developing apparatus comprising:

a developer roller to rotate in a rotation direction;

a photosensitive body adjacent the developer roller, wherein a closest position is defined where the developer roller and the photosensitive body are closest to one another;

a developer container that houses the developer roller, wherein the developer roller extends longitudinally in the developer container, and the developer roller has longitudinal ends; and an air flow passage to direct an air flow along the rotation direction of the developer roller, from inside the developer container toward an upstream side of the closest position, relative to the rotation direction of the developer roller, wherein the air flow passage extends between an inlet to draw in air adjacent the developer roller and an outlet to discharge the air out of the developer container, and wherein the inlet comprises an opening extending through at least one of the longitudinal ends of the developer roller.

12. The developing apparatus of claim 11, comprising a layer regulating member wherein, relative to the rotation direction of the developer roller, the layer regulating member is located at the upstream side of the closest position between the developer roller and the photosensitive body, the air flow passage to direct the air flow to a downstream side of the layer regulating member relative to the rotation direction of the developer roller.

13. The developing apparatus of claim 12, comprising a first seal member and a second seal member, wherein the second seal member is disposed in the developer container, wherein the second seal member is adjacent to or in contact with a developer on the developer roller, and wherein, relative to the rotation direction of the developer roller, the first seal member is located at the upstream side of the closest position between the photosensitive body and the developer roller, and at the downstream side of the layer regulating member, and the second seal member is located at a downstream side of the closest position between the photosensitive body and the developer roller.

14. The developing apparatus of claim 12, comprising an air vent with a filter in the developer container, wherein:

the closest position between the photosensitive body and the developer roller is a first closest position, a second closest position is defined where the developer roller and the developer container are closest to one another, and the air vent is located at a downstream side of the second closest position and at an upstream side of the layer regulating member, relative to the rotation direction of the developer roller.

* * * * *